US011628961B2

(12) United States Patent
Solanki et al.

(10) Patent No.: US 11,628,961 B2
(45) Date of Patent: Apr. 18, 2023

(54) PART PACKING SYSTEM AND METHOD

(71) Applicants: TE Connectivity Services GmbH, Schaffhausen (CH); Tyco Electronics (Shanghai) Co., Ltd., Shanghai (CN)

(72) Inventors: Swapnilsinh Solanki, Harrisburg, PA (US); An Yang, Shanghai (CN); Lvhai Hu, Shanghai (CN); Roberto Francisco-Yi Lu, Bellevue, WA (US); Sonny O. Osunkwo, Harrisburg, PA (US)

(73) Assignees: TE Connectivity Solutions GmbH, Schaffhausen (CH); Tyco Electronics (Shanghai) Co. Ltd., Shanghai (CN)

( * ) Notice: Subject to any disclaimer, the term of this patent is extended or adjusted under 35 U.S.C. 154(b) by 37 days.

(21) Appl. No.: 17/308,230

(22) Filed: May 5, 2021

(65) Prior Publication Data

US 2022/0315258 A1 Oct. 6, 2022

(30) Foreign Application Priority Data

Apr. 2, 2021 (CN) ..... 202110359947.1

(51) Int. Cl.

| | |
|---|---|
| ***B65B 35/18*** | (2006.01) |
| ***B65B 5/04*** | (2006.01) |
| ***B65B 43/46*** | (2006.01) |
| ***B65B 43/30*** | (2006.01) |
| ***B65B 35/16*** | (2006.01) |

(Continued)

(52) U.S. Cl.

CPC ..... *B65B 35/18* (2013.01); *B65B 5/022* (2013.01); *B65B 5/045* (2013.01); *B65B 19/34* (2013.01); *B65B 35/16* (2013.01); *B65B 39/007* (2013.01); *B65B 39/06* (2013.01); *B65B 43/30* (2013.01); *B65B 43/465* (2013.01)

(58) Field of Classification Search

CPC B65B 5/022; B65B 5/045; B65B 9/13; B65B 9/14; B65B 19/34; B65B 35/16; B65B 35/18; B65B 39/007; B65B 39/06; B65B 43/30; B65B 43/465

USPC ..... 53/459, 567, 570, 236, 386.1

See application file for complete search history.

(56) References Cited

U.S. PATENT DOCUMENTS 2,707,044 A * 4/1955 Steck ..... B65B 35/16 198/378

4,419,854 A * 12/1983 Okada et al. ..... B65B 9/13 53/512

(Continued)

FOREIGN PATENT DOCUMENTS

CH 646659 A5 * 12/1984 ..... B65B 19/34

*Primary Examiner* — Stephen F. Gerrity

(57) ABSTRACT

A part packing system includes a bag holding machine including a part funnel having an opening configured to receive an end of a part and having a bag end manipulator holding first and second bag end gripper mechanisms that receive an end of the bag therebetween to open the end of the bag to form a mouth at the end of the bag. The bag end manipulator moves the first and second bag end gripper mechanisms to position the mouth of the bag immediately downstream of the opening of the part funnel. A part loading machine including a part manipulator holding the part and moving the part to a loading position upstream of the part funnel and moving the part gripper mechanism to load an end of the part through the opening in the part funnel into the mouth of the bag to load the part into the bag.

21 Claims, 7 Drawing Sheets

(51) Int. Cl.

| | |
|---|---|
| ***B65B 39/00*** | (2006.01) |
| ***B65B 5/02*** | (2006.01) |
| ***B65B 39/06*** | (2006.01) |
| ***B65B 19/34*** | (2006.01) |

(56) References Cited

U.S. PATENT DOCUMENTS

| | | | | |
|---|---|---|---|---|
| 5,179,819 | A * | 1/1993 | Sukeyasu et al. | B65B 9/13 53/442 |
| 6,996,954 | B1 * | 2/2006 | Farley et al. | B65B 9/13 53/567 |
| 11,148,843 | B2 * | 10/2021 | Giublin et al. | B65B 43/465 |
| 2015/0020477 | A1 * | 1/2015 | Li | B65B 43/465 53/386.1 |
| 2016/0096641 | A1 * | 4/2016 | Tiffany et al. | B65B 9/13 53/469 |
| 2021/0371145 | A1 * | 12/2021 | Nishikawa et al. | B65B 35/18 |

* cited by examiner

PART PACKING SYSTEM AND METHOD

CROSS REFERENCE TO RELATED APPLICATIONS

This application claims benefit to Chinese Application No. 202110359947.1, filed 2-Apr.-2021, the subject matter of which is herein incorporated by reference in its entirety.

BACKGROUND OF THE INVENTION

The subject matter herein relates generally to part packing systems and methods.

Bagging and packaging of irregular shaped parts is difficult. For example, elongated parts, such as those having length to width or diameter ratios of greater than 20:1, are difficult to put into bags for packaging. Typically, bagging and packaging of such irregular shaped parts is a manual process due to complexity of automated processes.

A need remains for an automated part packing system and method for irregular shaped parts.

BRIEF DESCRIPTION OF THE INVENTION

In one embodiment, a part packing system for packing a part elongated along a longitudinal axis in an elongated bag is provided. The part packing system includes a bag holding machine including a part funnel having an opening configured to receive an end of the part. The bag holding machine includes a bag end manipulator holding a first bag end gripper mechanism and a second bag end gripper mechanism. The bag holding machine configured to receive an end of the bag between the first and second bag end gripper mechanisms. The first and second bag end gripper mechanisms open the end of the bag to form a mouth at the end of the bag. The bag end manipulator moves the first and second bag end gripper mechanisms to position the mouth of the bag immediately downstream of the opening of the part funnel. The part packing system includes a part loading machine including a part manipulator holding at least one part gripper mechanism configured to hold the part. The part manipulator moves the part gripper mechanism to a loading position upstream of the part funnel. The part manipulator moves the part gripper mechanism to load an end of the part through the opening in the part funnel into the mouth of the bag to load the part into the bag.

In another embodiment, a part packing system for packing a part elongated along a longitudinal axis in an elongated bag is provided. The part packing system includes a bag dispensing machine having a supply of elongated bags located adjacent a bag rail. The bag dispensing machine has a bag manipulator holding a bag gripper mechanism. The bag manipulator moves the bag gripper mechanism to pull a length of the bag from the supply along the bag rail. The bag dispensing machine has a cutter configured to cut the elongated bag from the supply. The part packing system includes a bag holding machine including a bag end manipulator holding a first bag end gripper mechanism and a second bag end gripper mechanism. The bag holding machine configured to receive an end of the bag between the first and second bag end gripper mechanisms. The first and second bag end gripper mechanisms open the end of the bag to form a mouth at the end of the bag. The part packing system includes a part loading machine includes a part manipulator holding at least one part gripper mechanism configured to hold the part. The part manipulator moves the part gripper mechanism to a loading position upstream of the mouth of the bag. The part manipulator moves the part gripper mechanism to load an end of the part into the mouth of the bag to load the part into the bag.

In a further embodiment, a method of packing a part in an elongated bag elongated along a longitudinal axis is provided. The method grabs a top of the elongated bag at an end of the bag using a first bag end gripper mechanism. The method grabs a bottom of the elongated bag at the end of the bag using a second bag end gripper mechanism. The method opens the end of the elongated bag to form a mouth and moves the mouth of the bag into alignment with an opening of a part funnel. The method grabs the part using a part gripper mechanism and loads the part into the mouth of the bag through the opening in the part funnel.

DETAILED DESCRIPTION OF THE INVENTION

Figure 1:
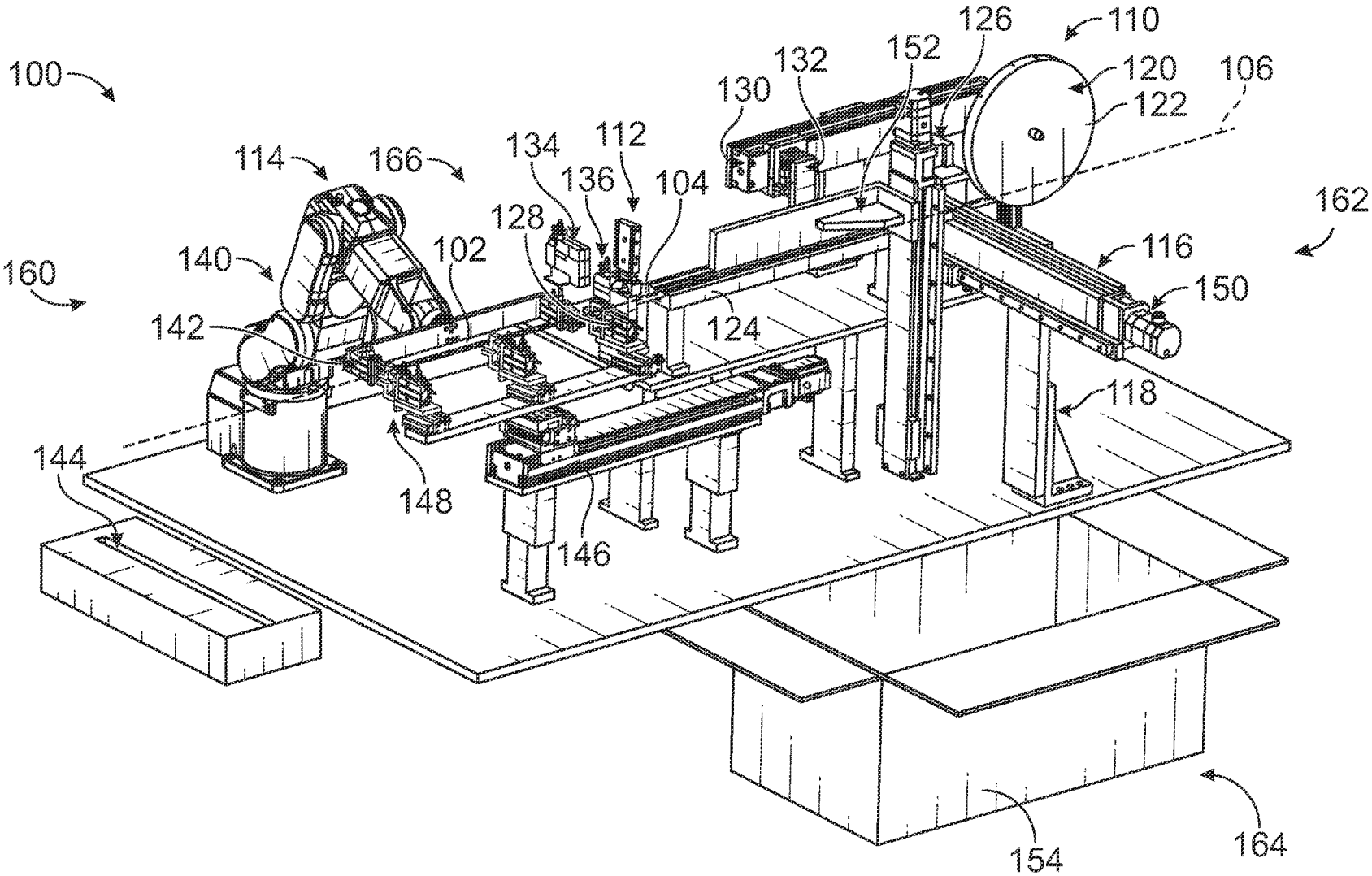
FIG. 1 is a perspective view of a part packing system in accordance with an exemplary embodiment.

FIG. 1 is a perspective view of a part packing system 100 in accordance with an exemplary embodiment. In an exemplary embodiment, the part packing system 100 is used for packing peculiar shaped parts 102, such as oblong or elongated parts, into an appropriately sized and shaped elongated bag 104. The final product (for example, the part 102 loaded in the bag 104) is packed into a packaging container, such as a box or bin, by the part packing system 100. The part 102 is elongated along a longitudinal axis 106. In various embodiments, the part 102 may be generally cylindrical shaped or tubular shape. The elongated bag 104 is similarly tubular shaped to receive the elongated part 102. In various embodiments, the part 102 may have a length to diameter ratio greater than 10:1. The part may have a length to diameter ratio greater than 20:1 in various embodiments or 30:1 in other various embodiments. In an exemplary embodiment, the part packing system 100 is an automated system using machines to pack the part 102 into the elongated bag 104. For example, the part packing system 100 may load the part 102 into the elongated bag 104 without human intervention. The product may then be packaged in the container, such as with other products.

In an exemplary embodiment, the part packing system 100 includes a bag dispensing machine 110, a bag holding machine 112, a part loading machine 114, and a product packing machine 116. The part packing system 100 may include other machines for performing other processes in alternative embodiments. In an exemplary embodiment, the machines 110, 112, 114, 116 of the part packing system 100 may be held together on a common frame 118. The frame 118 may include vertical beams, horizontal beams, cross-beams, walls, plates or other structural elements that define the frame 118 of the part packing system 100. The frame 118 supports the machines 110, 112, 114, 116 at predetermined positions relative to each other. The parts of the frame 118 may be secured together by fasteners or welding. The machines 110, 112, 114, 116 may be coupled to the frame 118, such as using fasteners, mounting brackets, welding, and the like.

The bag dispensing machine 110 is used to dispense the elongated bags 104 from a supply, such as a continuous reel or spool. The bag holding machine 112 is used to hold the elongated bag 104 during the packing process. The part loading machine 114 is used for packing the part 102 in the elongated bag 104 held by the bag holding machine 112. When the part is packaged in the elongated bag, the combined part\bag product may be further processed at the product packing machine 116. For example, the products may be loaded into a box or bin at the product packing machine 116. The products may be labeled at the product packing machine 116 or at a downstream product labeling machine.

The bag dispensing machine 110 holds a supply 120 of the elongated bags 104. In various embodiments, the supply of elongated bags 104 may be arranged as a roll, such as on a spool or reel 122. The reel 122 may be held on a stand or other fixture. The elongated bags 104 are delivered to a bag dispensing location, such as along a rail 124 or platform. In an exemplary embodiment, the elongated bags 104 may be a continuous roll of the elongated bags 104, which may be cut to length. For example, the elongated bags 104 may be formed from a continuous plastic tube. In an exemplary embodiment, the bag dispensing machine 110 includes a cutter 126 used to separate the elongated bags 104 from the continuous supply 120. The cutter 126 cuts the elongated bags 104 to length. Optionally, the bag dispensing machine 110 may be configured to dispense different lengths of elongated bags 104 for receiving different length parts 102.

The bag holding machine 112 retrieves the elongated bags 104 from the bag dispensing machine 110 and moves the elongated bags 104 to a part loading station 128. In an exemplary embodiment, the bag holding machine 112 includes a bag manipulator 130 and a bag gripper mechanism 132 mounted to the bag manipulator 130. The bag gripper mechanism 132 is configured to grab or hold an end (or end portion) of the elongated bag 104. The bag manipulator 130 may be movable relative to the supply 120. For example, the bag manipulator 130 may be movable in 1 dimension (for example, axially) or in two dimensions (for example, in two perpendicular directions) or in three dimensions (for example, in three mutually perpendicular directions). The bag manipulator 130 is operated to move the bag gripper mechanism 132. For example, the bag manipulator 130 moves the bag gripper mechanism 132 to pick up the elongated bag 104 and also moves to position the elongated bag 104 at the part loading station 128. In an exemplary embodiment, the bag manipulator 130 may be a multi-axis robot configured to move in three-dimensional space. In an alternative embodiment, the bag manipulator 130 includes a gantry for controlled movement in two perpendicular directions. In an exemplary embodiment, the bag gripper mechanism 132 include one or more suction cups used to hold the elongated bag 104. The bag gripper mechanism 132 may hold the elongated bag 104 by vacuum pressure. In other various embodiments, the bag gripper mechanism 132 may include gripping fingers configured to pinch the elongated bag 104 to hold the elongated bag 104. Other types of gripper mechanisms may be used in alternative embodiments.

In an exemplary embodiment, the bag holding machine 112 includes a second bag manipulator that manipulates the end of the bag. The bag holding machine 112 includes a bag end manipulator 134 and a bag end gripper mechanism 136 mounted to the bag end manipulator 134. The bag end gripper mechanism 136 is configured to pick up the end of the elongated bag 104 and open the end of the bag 104. The bag end manipulator 134 is movable relative to the part loading station 128. In an exemplary embodiment, the bag end manipulator 134 may be a multi-axis robot configured to move in three-dimensional space. In an alternative embodiment, the bag end manipulator 134 includes a gantry for controlled movement in a single axis, in two perpendicular directions, or in three mutually perpendicular directions. In an exemplary embodiment, the bag end gripper mechanism 136 include one or more suction cups used to hold the end of the elongated bag 104. The bag end gripper mechanism 136 may hold the elongated bag 104 by vacuum pressure. In other various embodiments, the bag end gripper mechanism 136 may include gripping fingers configured to pinch the elongated bag 104 to hold the end of the elongated bag 104. Other types of gripper mechanisms may be used in alternative embodiments.

The part loading machine 114 retrieves the part 102 and loads the part 102 into the elongated bag 104 at the part loading station 128. In an exemplary embodiment, the part loading machine 114 includes a part manipulator 140 and a part gripper mechanism 142 mounted to the part manipulator 140. The part gripper mechanism 142 may pick up the part 102 from an end of the part 102 or from the middle of the part 102. The part manipulator 140 may be movable in three-dimensional space to move the part gripper mechanism 142 relative to the bag 104. For example, the part manipulator 140 moves the part gripper mechanism 142 to pick up the part 102 at a part retrieval location 144, move the part 102 to a loading position relative to the elongated bag 104, and loads the part 102 into the elongated bag 104. Optionally, multiple parts 102 may be stored at the part retrieval location 144 or transported to the part retrieval location 144, such as by a conveyor or in a supply bin.

In an exemplary embodiment, the part loading machine 114 includes multiple part manipulators for moving the part 102. For example, the part manipulator 140 is a first part manipulator and the part loading machine 114 includes a second part manipulator 146 having a second part gripper mechanism 148. The first part manipulator 140 may be used to pick up the part from the part retrieval location 144 and transfer the part 102 to the second part manipulator 146. The second part manipulator 146 is used to load the part 102 into the bag 104. In an exemplary embodiment, the part manipulator 140 may be a multi-axis robot configured to move in three-dimensional space. In an exemplary embodiment, the part gripper mechanism 142 may include gripping fingers or jaws configured to pinch the part 102 to hold the elongated part 102. In other various embodiments, the part gripper mechanism 142 include one or more suction cups used to hold the part 102. The part gripper mechanism 142 may hold the part 102 by vacuum pressure. Other types of gripper mechanisms may be used in alternative embodiments. In an exemplary embodiment, the second part manipulator 146 may be a gantry configured to move along a single axis or in two perpendicular axes. In an exemplary embodiment, the second part gripper mechanism 148 may include gripping fingers or jaws configured to pinch the part 102 to hold the elongated part 102. In other various embodiments, the second part gripper mechanism 148 includes one or more suction cups used to hold the part 102. The second part gripper mechanism 148 may hold the part 102 by vacuum pressure. Other types of gripper mechanisms may be used in alternative embodiments.

The product packing machine 116 includes a bin, box, or other container 154 that receives the products (for example, the elongated bag 104 with the part 102 loaded inside the elongated bag 104). The product packing machine 116 includes a product manipulator 150 that holds a product gripper mechanism 152. The product manipulator 150 transports the product to the container 154. For example, the product gripper mechanism 152 may pick up the product for transportation. In various embodiments, the product packing machine 116 may include a sealing device for sealing the first end and/or the second end of the elongated bag 104 to close the part 102 in the elongated bag 104. In various embodiments, the product packing machine 116 may include a labeling device, such as for applying a shipping label or other appropriate labels to the product or the container 154.

In an exemplary embodiment, the elongated parts 102 are loaded into the elongated bags 104 by an automated process using the part packing system 100. The various machines retrieve then position the elongated bag 104 for loading the elongated part 102 into the elongated bag 104 and package the product for further processing or shipping. The loading and moving of the part 102, the elongated bag 104 and the finished product is performed automatically by the machines without human intervention.

In an exemplary embodiment, the part packing system 100 extends between a front 160 and a rear 162. The part packing system 100 has a first side 164 and a second side 166. In the illustrated embodiment, the container 154 is located at the first side 164. The reel 122 is located at the rear 162. The bag 104 is pulled forward from the reel 122 along the rail 124. The part loading machine 114 is located at the front 160, such as forward of the rail 124. Other orientations of the machines are possible in alternative embodiments.

Figure 2:
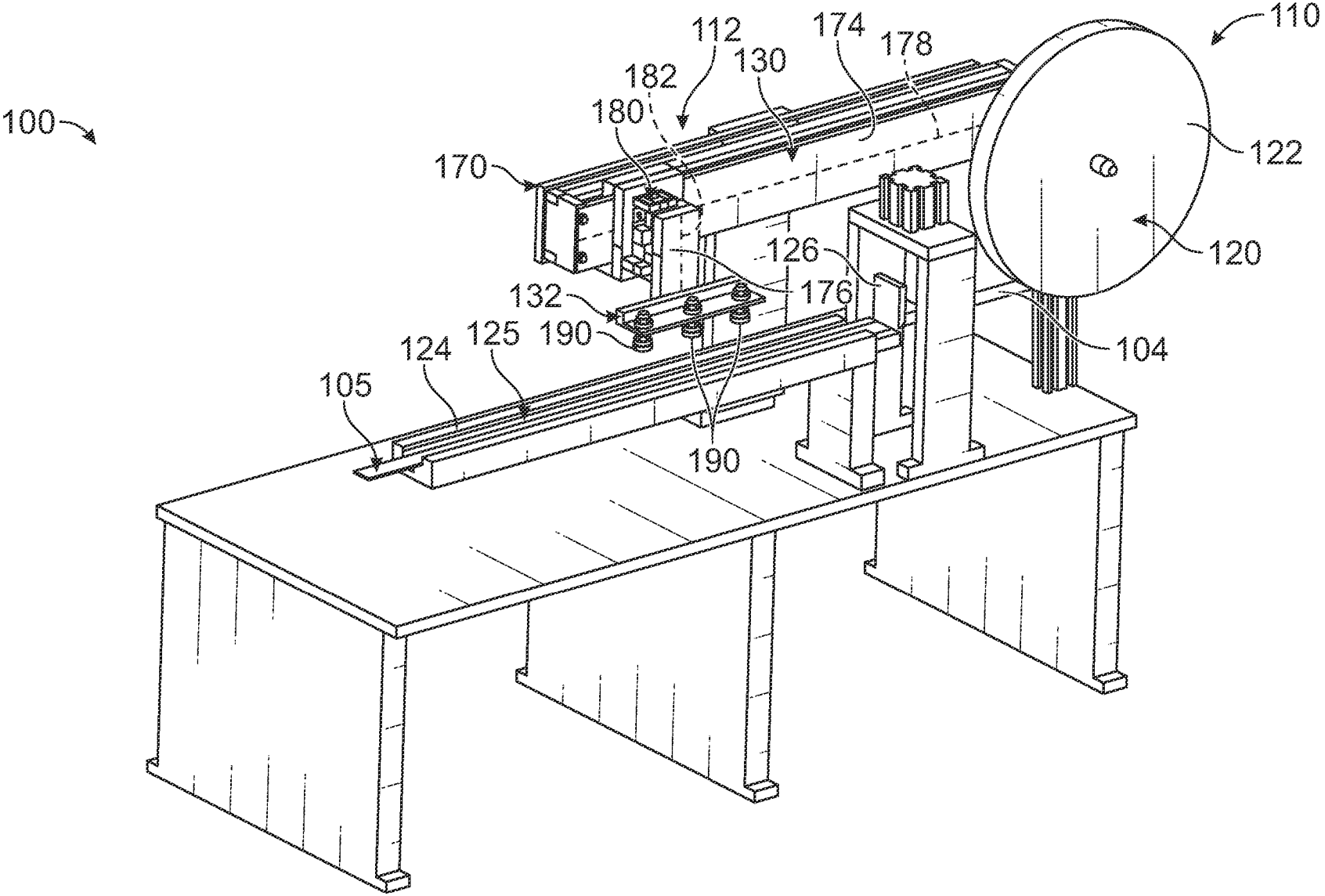
FIG. 2 is a front perspective view of a portion of the part packing system in accordance with an exemplary embodiment.

FIG. 2 is a front perspective view of a portion of the part packing system 100 in accordance with an exemplary embodiment. FIG. 2 illustrates the bag dispensing machine 110 and a portion of the bag holding machine 112. The bag gripper mechanism 132 is maneuvered by the bag manipulator 130 to the bag dispensing location to pick up the elongated bag 104 from the reel 122. The bag manipulator 130 is configured to move the bag gripper mechanism 132 away from the bag dispensing machine 110, such as forwardly along the top of the rail 124 toward the part loading station. In an exemplary embodiment, the rail 124 includes a slot or track 125 at the top of the rail 124. The bag 104 is received in the track 125. The track 125 may have a width slightly larger than the width of the bag 104 to position the bag 104 on the rail 124.

In an exemplary embodiment, the cutter 126 is located adjacent the rail 124, such as above the rail 124. The bag 104 is dispensed along the rail 124 to a predetermined length and then the cutter 126 is operated to separate the bag 104 from the supply 120. In an exemplary embodiment, the bag 104 is pulled forward to a position that an end 105 of the bag 104 is located forward of the rail 124 such that the end 105 of the bag 104 is accessible for grabbing by the bag end gripper mechanism 138 (shown in FIG. 1). For example, the bag end gripper mechanism 138 may grab the end 105 of the bag 104 from above and below.

In an exemplary embodiment, the bag holding machine 112 retrieves the elongated bags 104 from the bag dispensing machine 110. In the illustrated embodiment, the bag manipulator 130 includes a gantry 170 used to control positioning of the bag gripper mechanism 132. For example, the gantry 170 includes a gantry rail 174 and a sled 176 movable along the gantry rail 174. In the illustrated embodiment, the sled 176 is movable along a first axis 178, such as a horizontal axis. For example, the sled 176 may slide along the gantry rail 174 front-to-rear and rear-to-front. The gantry 170 includes a vertical actuator 180 on the sled 176. The bag gripper mechanism 132 is coupled to the vertical actuator 180. The vertical actuator 180 is movable along a second axis 182, such as a vertical axis, to move the bag gripper mechanism 132 along the second axis 182. For example, the vertical actuator 180 moves the bag gripper mechanism 132 upward and downward when operated. Other types of bag manipulators 130 may be used in alternative embodiments, such as a multi-axis robot.

The bag gripper mechanism 132 includes one or more end effectors 190 configured to engage the bag 104 and move the bag 104. For example, the end effectors 190 may be suction cups configured to grab the bag 104. The end effectors 190 may hold the bag 104 by vacuum pressure. In other various embodiments, the end effectors 190 may include gripping fingers configured to pinch the bag 104 to hold the bag 104. Other types of gripper mechanisms may be used in alternative embodiments. In the illustrated embodiment, the bag gripper mechanism 132 includes three end effectors 190 arranged in a row to pick up a length of the bag 104 at multiple locations, rather than at a single pick-up point.

During operation, the bag gripper mechanism 132 is moved to a pick-up position. The bag manipulator 130 moves the bag gripper mechanism 132 rearward toward the supply 120. For example, the sled 176 is moved rearward along the gantry rail 174. The bag gripper mechanism 132 is moved downward to interface with the bag 104. For example, the vertical actuator 180 is operated to move the end effectors 190 downward toward the rail 124 to grab the bag 104. The bag manipulator 130 is operated to move the bag gripper mechanism 132 forward with the bag 104 to unroll the bag 104 along the rail 124. For example, the sled 176 is moved forward along the gantry rail 174 to unroll the bag 104. The bag gripper mechanism 132 is moved to a drop-off position. At the drop off position, the end effectors 190 release the bag 104 onto the rail 124.

Figure 3:
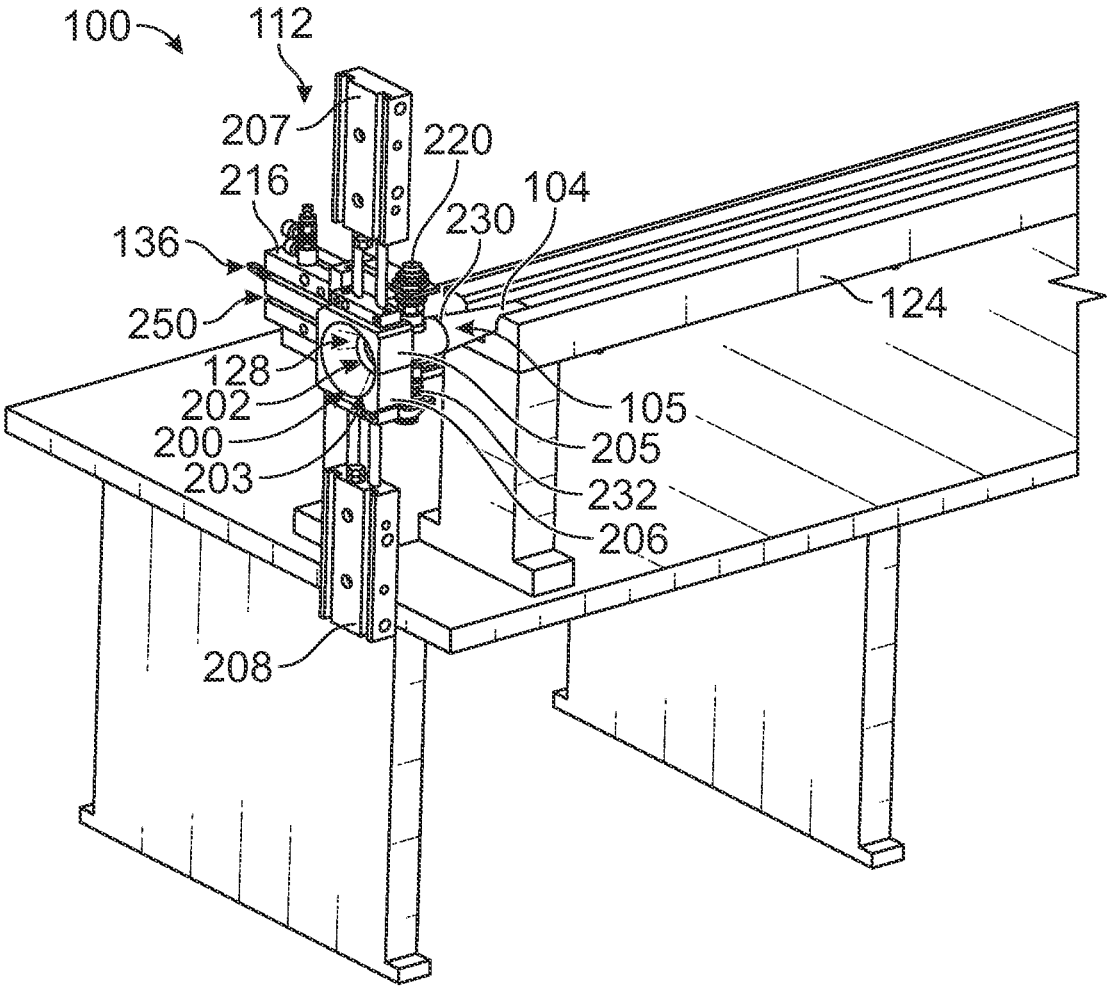
FIG. 3 is a front perspective view of a portion of the part packing system in accordance with an exemplary embodiment.
Figure 4:
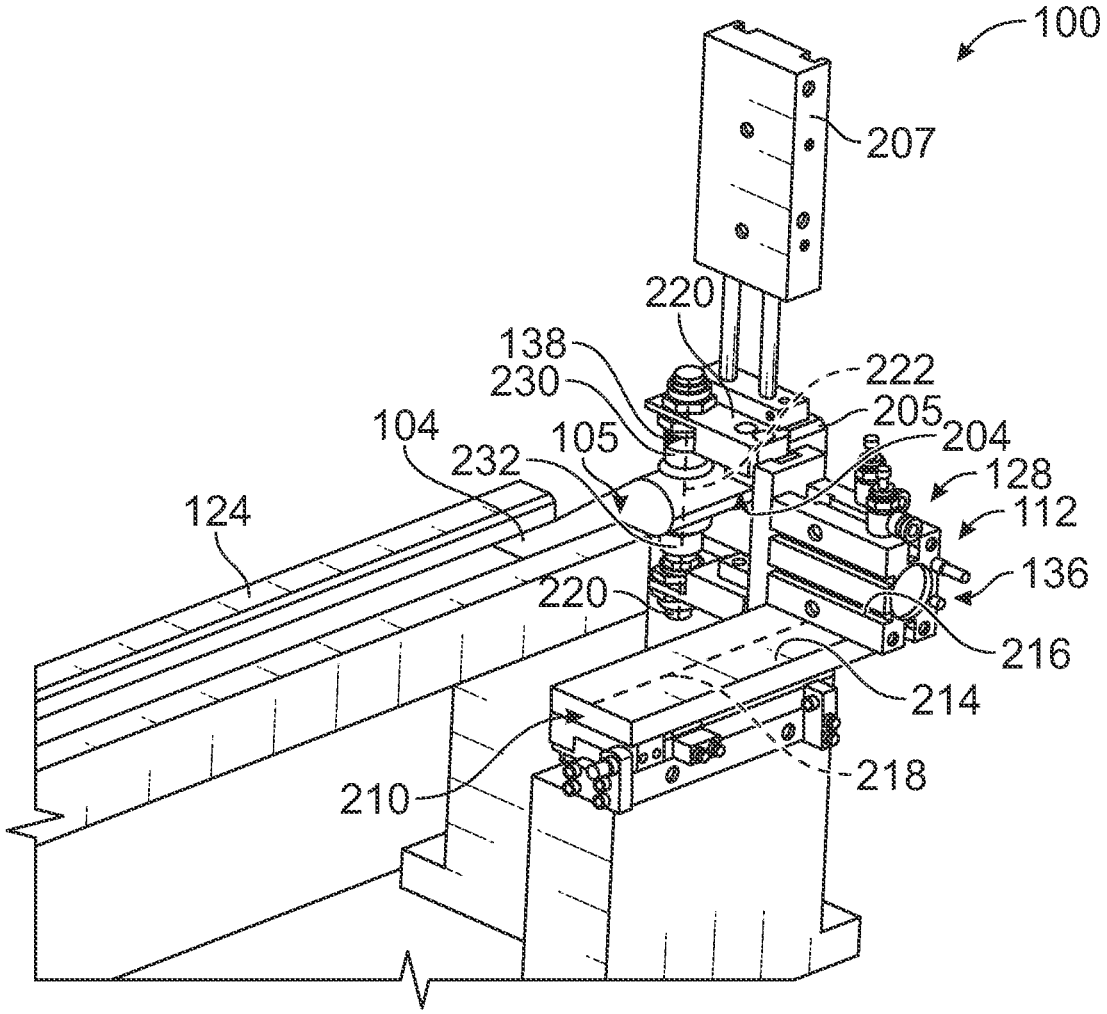
FIG. 4 is a rear perspective view of a portion of the part packing system in accordance with an exemplary embodiment.

FIG. 3 is a front perspective view of a portion of the part packing system 100 in accordance with an exemplary embodiment. FIG. 4 is a rear perspective view of a portion of the part packing system 100 in accordance with an exemplary embodiment. FIGS. 3 and 4 illustrate a portion of the bag holding machine 112 holding the elongated bag 104. The end 105 of the bag 104 is illustrated at the front end of the rail 124. In an exemplary embodiment, an end segment of the bag 104 extends forward of the end of the rail 124, such as for part loading.

The bag holding machine 112 includes the bag end manipulator 136 and the bag end gripper mechanism 138 used to pick up the end of the bag 104 from the rail 124. The bag end manipulator 136 is configured to move the bag end gripper mechanism 138 to the part loading station 128. In an exemplary embodiment, the bag holding machine 112 includes a part funnel 200 having an opening 202 configured to receive an end of the part. The bag end manipulator 136 moves the bag end gripper mechanism 138 to position the end 105 of the bag 104 immediately downstream of the opening 202 of the part funnel 200. The opening 202 is funnel shaped having a wide entry port 203 and a narrow exit part 204. The funnel shaped opening 202 is used to guide the part 102 into the bag 104. In an exemplary embodiment, the part funnel 200 is a multi-piece component. For example, the part funnel 200 includes an upper funnel 205 and a lower funnel 206. The upper funnel 205 and/or the lower funnel 206 may be movable relative to each to open and close the part funnel 200, such as for loading the part 102 into the bag 104. In an exemplary embodiment, the part funnel 200 includes an upper actuator 207 operably coupled to the upper funnel 205 and a lower actuator 208 operably coupled to the lower funnel 206. The upper actuator 207 moves the upper funnel 205 away from the lower funnel 206 and the lower actuator 208 moves the lower funnel 206 away from the upper funnel 205.

In an exemplary embodiment, the bag end manipulator 136 includes a gantry 210 used to control positioning of the bag end gripper mechanism 138. For example, the gantry 210 includes a gantry rail 214 and a sled 216 movable along the gantry rail 214. In the illustrated embodiment, the sled 216 is movable along a first axis 218. For example, the sled 216 may slide along the gantry rail 214 front-to-rear and rear-to-front. The gantry 210 includes one or more vertical actuator 220 on the sled 216 for supporting and moving the bag end gripper mechanism(s) 138. The vertical actuators 220 move the bag end gripper mechanisms 138 along a second axis 222, such as a vertical axis. For example, the vertical actuators 220 moves the bag end gripper mechanisms 138 upward and downward when operated. Other types of bag end manipulators 136 may be used in alternative embodiments, such as a multi-axis robot.

The bag end gripper mechanisms 138 include first and second end effectors 230, 232 configured to engage the bag 104 and move the bag 104. For example, the end effectors 230, 232 may be used to open the end 105 of the bag 104 to form an open mouth at the end 105 of the bag 104 to receive the part 102 therein. The end effectors 230, 232 are used to move the end 105 of the bag 104 to the opening 202 of the part funnel 200. The mouth of the bag 104 may be moved immediately downstream of the exit port 204 such that the part may be loaded into the open mouth as the part is loaded through the opening 202. In an exemplary embodiment, the end effector 230 is an upper end effector and the end effector 232 is a lower end effector. The end effectors 230, 232 interface with the top and the bottom of the bag 104, respectively. The end effectors 230, 232 may be suction cups configured to grab the bag 104. The end effectors 230, 232 may hold the bag 104 by vacuum pressure. In other various embodiments, the end effectors 230, 232 may include gripping fingers configured to pinch the bag 104 to hold the bag 104. Other types of gripper mechanisms may be used in alternative embodiments.

During operation, the bag end gripper mechanism 138 is moved to the end of the rail 124 to pick up the end 105 of the bag 104. The bag end manipulator 136 moves the bag end gripper mechanism 138 to a rearward position to pick up the end of the bag 104 from the end of the rail 124. For example, the sled 216 is moved rearward along the gantry rail 214. The bag end gripper mechanism 138 may be closed around the end 105 of the bag 104. For example, the end effectors 230, 232 may be clamped onto the top and bottom of the bag 104 to interface with the bag 104. The end effectors 230, 232 may be opened, such as being spread apart from each other, to open the mouth of the bag 104. The bag end manipulator 136 is operated to move the bag end gripper mechanism 138 forward with the bag 104 to position the mouth of the bag 104 at the part funnel 200 to receive the part 102. For example, the sled 216 is moved forward along the gantry rail 214 to pull the bag 104 forward to the rear side of the part funnel 200.

Figure 5:
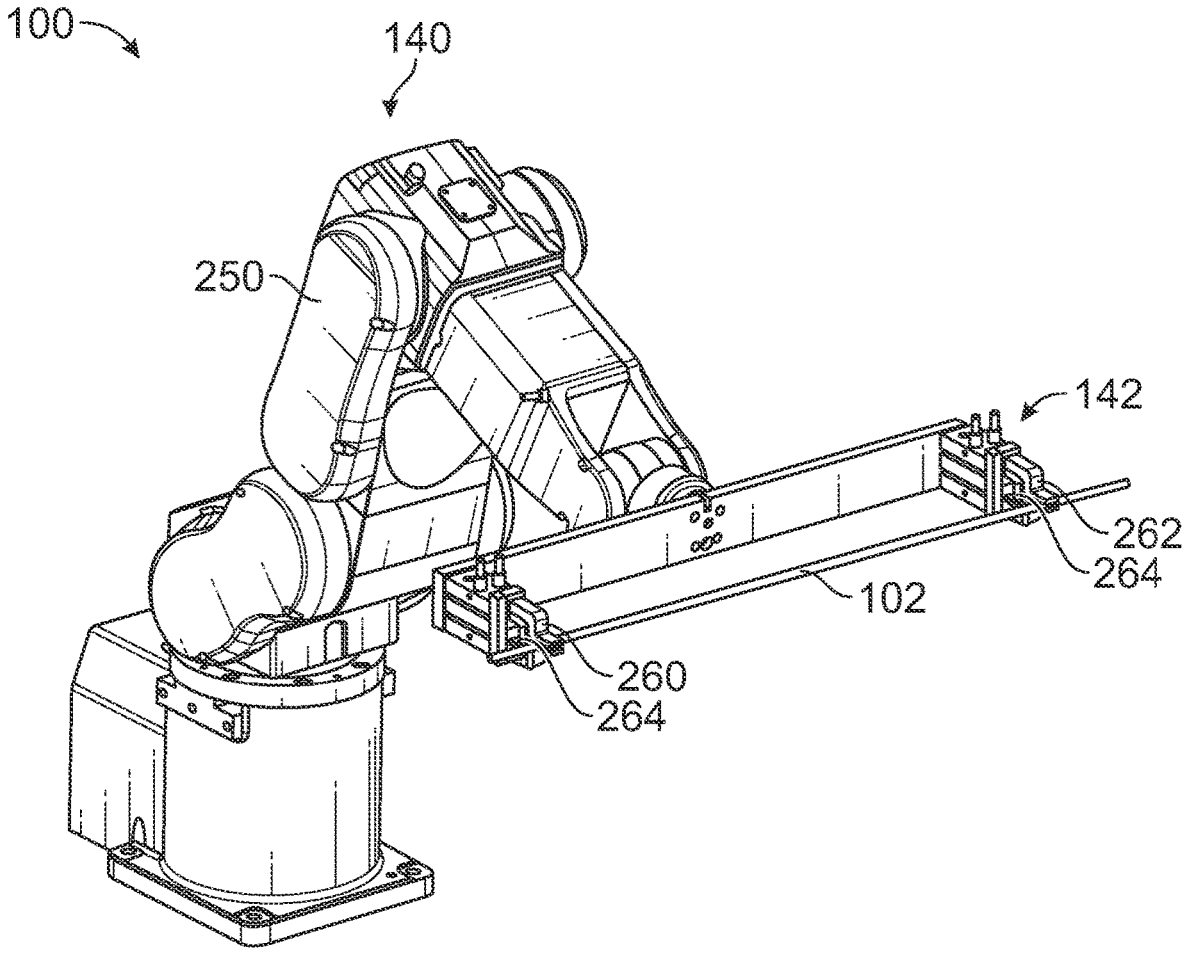
FIG. 5 is a perspective view of a portion of the part packing system in accordance with an exemplary embodiment showing the first part manipulator and the first part gripper mechanism.

FIG. 5 is a perspective view of a portion of the part packing system 100 in accordance with an exemplary embodiment showing the first part manipulator 140 and the first part gripper mechanism 142. In the illustrated embodiment, the first part manipulator 140 is a multi-axis robot movable in three-dimensional space. Alternatively, the first part manipulator 140 may include a gantry system.

The first part manipulator 140 includes an arm 250, such as a robot arm movable in three-dimensional space. For example, the arm 250 may be movable front-to-rear, side-to-side, up-down or may be rotated. The first part gripper mechanism 142 is mounted to an end of the arm 250. The arm 250 moves the first part gripper mechanism 142 from a part pickup station to a part loading station. In an exemplary embodiment, the first part manipulator 140 positions the first part gripper mechanism 142 directly in line with the second part gripper mechanism 148 (shown in FIG. 6). The first part gripper mechanism 142 transfers the part 102 from the part pickup station to the second part gripper mechanism 148.

In an exemplary embodiment, the first part gripper mechanism 142 includes a first end effector 260 and a second end effector 262. The first and second end effectors 260, 262 hold opposite ends of the part 102. The first part gripper mechanism 142 may have greater or fewer end effectors 260, 262 in alternative embodiments. In an exemplary embodiment, the first and second end effectors 260. 262 include fingers 264 configured to grip the part 102. In an exemplary embodiment, the fingers 264 are movable relative to each other, such as to close and open to grip and release the part 102. In an exemplary embodiment, the fingers 264 hold the part 102 using a compressive force. For example, part 102 may be pinched between the fingers 264. Other types of end effectors may be used in alternative embodiments, such as suction cups.

Figure 6:
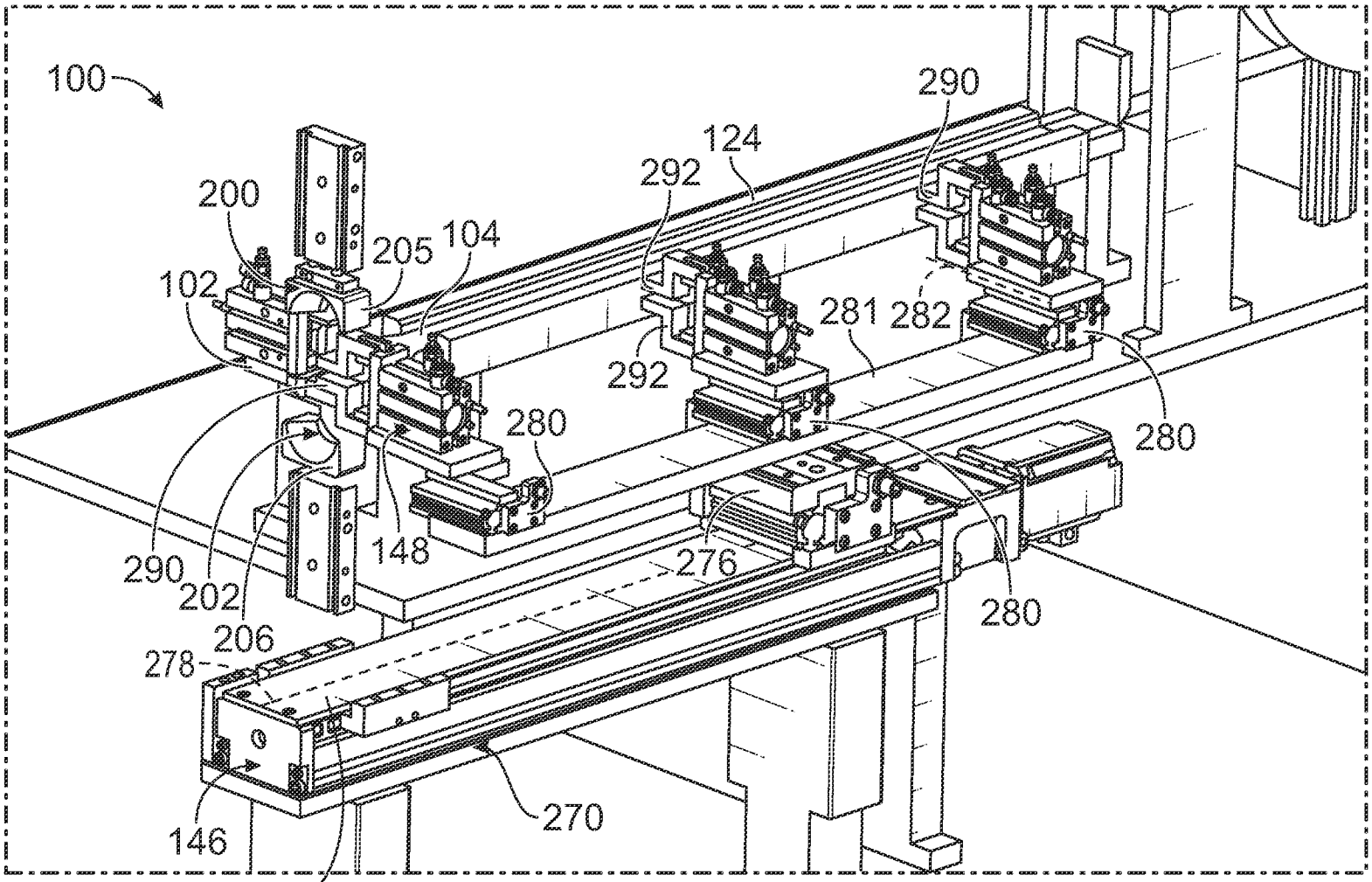
FIG. 6 is a perspective view of a portion of the part packing system in accordance with an exemplary embodiment showing the second part manipulator and the second part gripper mechanism.

FIG. 6 is a perspective view of a portion of the part packing system 100 in accordance with an exemplary embodiment showing the second part manipulator 146 and the second part gripper mechanism 148. In the illustrated embodiment, the second part manipulator 146 includes a gantry 270 used to control positioning of the second part gripper mechanism 148. For example, the gantry 270 includes a gantry rail 274 and a sled 276 movable along the gantry rail 274. In the illustrated embodiment, the sled 276 is movable along a first axis 278, such as a horizontal axis. For example, the sled 276 may slide along the gantry rail 274 front-to-rear and rear-to-front. The gantry 270 includes a side actuator 280 mounted to a tray 281 carried by the sled 276. The side actuators 280 hold the second part gripper mechanisms 148. The side actuators 280 are movable along a second axis 282, such as a horizontal axis, perpendicular to the first axis 278. The side actuators 280 move the second part gripper mechanisms 148 toward and away from the rail 124. Other types of part manipulators may be used in alternative embodiments, such as a multi-axis robot rather than a gantry system.

The second part gripper mechanisms 148 includes end effectors 290 configured to engage the part 102 and load the part 102 into the bag 104. For example, the end effectors 290 may include gripping fingers 292 used to grab the part 102. The gripping fingers 292 may grab the part from the first part gripper mechanism 142 (shown in FIG. 5). In the illustrated embodiment, the second part gripper mechanism 148 includes three end effectors 290 arranged in a row to hold the elongated part 102. The fingers 292 are movable relative to each other, such as to close and open to grip and release the part 102. In an exemplary embodiment, the fingers 292 hold the part 102 using a compressive force. For example, part 102 may be pinched between the fingers 292. Other types of end effectors may be used in alternative embodiments, such as suction cups.

During operation, the first part gripper mechanism 142 transfers the part 102 to the second part gripper mechanism 148 in front of the part funnel 200 and in front of the bag 104. Once the part 102 is transferred to the second part gripper mechanism 148, the second part manipulator 146 is used to load the part 102 into the bag 104. The second part manipulator 146 moves the part 102 rearward. The part 102 is loaded through the opening 202 in the part funnel 200 into the bag 104. The part 102 is moved rearward to load the part 102 into the bag 104. The part 102 may be loaded into the bag 104 on the rail 124. Once the part 102 is partially loaded into the bag 104, the part funnel 200 is no longer needed to guide the part 102. In an exemplary embodiment, the part funnel 200 is opened, such as by spreading the upper and lower funnels 205. 206 apart. The end effectors 290 may pass through the space created between the upper and lower funnels 205, 206 as the second part manipulator 146 is moved rearward. In an exemplary embodiment, after the end effector 290 passes through the part funnel 200, the end effector 290 may be retracted. For example, the side actuator 280 may be operated to slide the end effector 290 sideways and out of the way of the bag 104 and the rail 124 as the second part manipulator 146 continues to move the end effector 290 rearward.

Figure 7:
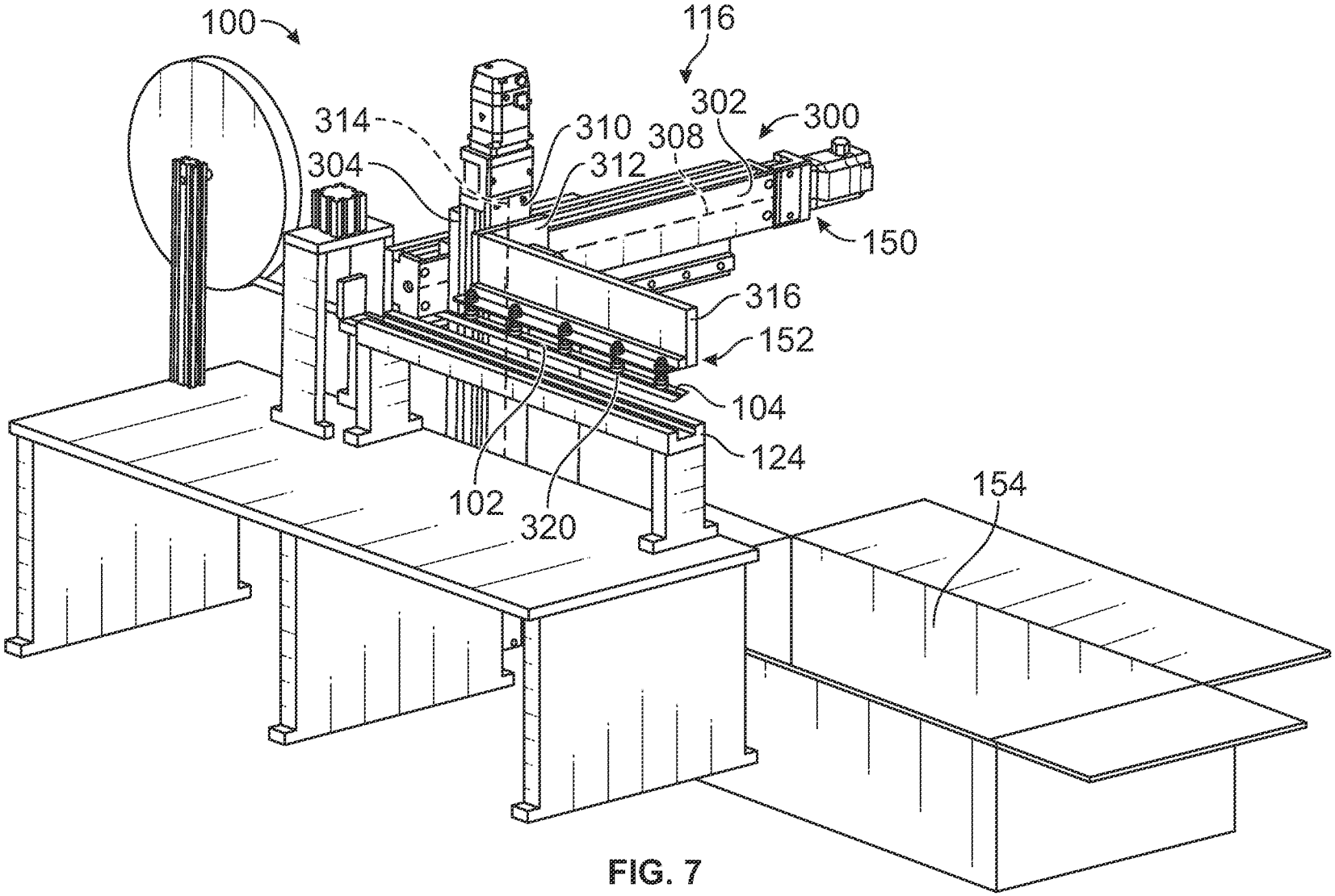
FIG. 7 is a perspective view of a portion of the part packing system in accordance with an exemplary embodiment showing the product packing machine.

FIG. 7 is a perspective view of a portion of the part packing system 100 in accordance with an exemplary embodiment showing the product packing machine 116. The product packing machine 116 includes the product manipulator 150 and the product gripper mechanism 152 used to move the product (part 102 loaded in the bag 104) into the container 154. The product gripper mechanism 152 picks up the product and transports the product to the container 154. In various embodiments, the product packing machine 116 may include a sealing device for sealing the first end and/or the second end of the elongated bag 104 to close the part 102 in the elongated bag 104. In various embodiments, the product packing machine 116 may include a labeling device, such as for applying a shipping label or other appropriate labels to the product or the container 154.

In the illustrated embodiment, the product manipulator 150 includes a gantry 300 used to control positioning of the product gripper mechanism 152. For example, the gantry 300 includes a gantry rail 302 and a sled 304 movable along the gantry rail 302. In the illustrated embodiment, the sled 304 is movable along a first axis 308, such as a horizontal axis. For example, the sled 304 may slide along the gantry rail 302 side-to-side, such as away from the rail 124. In an exemplary embodiment, the product manipulator 150 includes a second gantry rail 310 and a second sled 312 movable along the second gantry rail 310. The second gantry rail 310 is oriented vertically to allow the second sled 312 movable along a second axis 314 perpendicular to the first axis, such as a vertical axis. The second sled 312 holds a support arm 316 supporting the product gripper mechanism 152. In the illustrated embodiment, the product gripper mechanism 152 includes a plurality of end effectors 320 along the support arm 316. The second sled 312 is movable along the second gantry rail 310 to move the product gripper mechanism 152 toward and away from the rail 124, such as to pick up the product. Other types of part manipulators may be used in alternative embodiments, such as a multi-axis robot rather than a gantry system.

In an exemplary embodiment, the end effectors 320 are suction cups configured to grab the product. The end effectors 320 may hold the product by vacuum pressure. In other various embodiments, the end effectors 320 may include gripping fingers configured to pinch the product to hold the product. Other types of gripper mechanisms may be used in alternative embodiments.

During operation, the product gripper mechanism 152 transfers the product from the rail 124 to the container 154. For example, the end effectors 320 are lowered onto the package on top of the rail 124 to pick up the package. The package is lifted off of the rail 124 and shifted sideways over the top of the open container 154. The package may be lowered closer to the container 154 and then the product is released to drip the product into the container 154.

The part packing system 100 uses automated or computer controlled machines or devices to load the elongated part in the elongated bag. The part packing system 100 automates the process to load the parts into the elongated bags without human intervention. The part packing system 100 allows loading and packaging the parts in the bags quickly, repeatedly and consistently.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A part packing system for packing a part elongated along a longitudinal axis in an elongated bag, the part packing system comprising:

a bag holding machine including a part funnel having an opening configured to receive an end of the part, the bag holding machine including a bag end manipulator holding a first bag end gripper mechanism and a second bag end gripper mechanism, the bag holding machine configured to receive an end of the bag between the first and second bag end gripper mechanisms, the first and second bag end gripper mechanisms opening the end of the bag to form a mouth at the end of the bag, the bag end manipulator moving the first and second bag end gripper mechanisms to position the mouth of the bag immediately downstream of the opening of the part funnel; and a part loading machine including a part manipulator holding at least one part gripper mechanism configured to hold the part, the part manipulator moving the part gripper mechanism to a loading position upstream of the part funnel, the part manipulator moving the part gripper mechanism to load the end of the part through the opening in the part funnel into the mouth of the bag to load the part into the bag, wherein the part manipulator is movable in three-dimensional space to move the part gripper mechanism and the part relative to the bag.

2. The part packing system of claim 1, wherein the part funnel includes an upper funnel and a lower funnel, the upper funnel and the lower funnel being movable relative to each to open and close the funnel, the opening formed when the upper and lower funnel are closed.

3. The part packing system of claim 2, wherein the part gripper mechanism is movable through the part funnel when the upper funnel and the lower funnel are opened.

4. The part packing system of claim 1, wherein the part manipulator is a first part manipulator, the part loading machine including a second part manipulator having a second part gripper mechanism, the first part manipulator configured to pick up the part and move the part to the second part manipulator, the second part gripper mechanism configured to grab the part from the first part gripper mechanism, the second part manipulator moving axially in a loading direction to load the part into the bag.

5. The part packing system of claim 1, wherein the part funnel is funneled from a wide entry port to a narrow exit port narrower than the wide entry port, the bag end manipulator positioning the mouth of the bag at the exit port, the part manipulator loading the part through the entry port.

6. The part packing system of claim 1, wherein the first bag end gripper mechanism includes a first end effector and the second bag end gripper mechanism includes a second end effector opposing the first end effector across a bag holding space, the first end effector configured to hold a top of the bag and the second end effector configured to hold a bottom of the bag, at least one of the first end effector and the second end effector moving away from each other to open the bag and form the mouth.

7. The part packing system of claim 6, wherein the first end effector includes a suction cup and the second end effector includes a suction cup to hold the elongated bag.

8. The part packing system of claim 6, wherein the first end effector holds the elongated bag using vacuum pressure and the second effector holds the elongated bag using vacuum pressure.

9. The part packing system of claim 1, wherein the part gripper mechanism includes a first jaw element and a second jaw element movable relative to each other to grip and release the part.

10. The part packing system of claim 1, further comprising a bag dispensing machine having a supply of elongated bags located adjacent a bag rail, the bag dispensing machine having a bag manipulator holding a bag gripper mechanism, the bag manipulator moving the bag gripper mechanism to pull a length of the bag from the supply along the bag rail, the bag dispensing machine having a cutter configured to cut the elongated bag from the supply, the first and second bag end gripper mechanisms moving the end of the bag from the rail to the part funnel, the part manipulator loading the part into the bag along the bag rail.

11. The part packing system of claim 1, further comprising a product packaging machine configured to move the part and the bag when the part is in the bag, the product packaging machine having a product manipulator holding a product gripper mechanism, the product manipulator moving the product gripper mechanism away from the part funnel to a packaging container.

12. The part packing system of claim 1, further comprising a bag dispensing machine having a continuous supply of elongated bags, the bags being open at both ends, the bag dispensing machine having a bag manipulator holding a bag gripper mechanism holding one of the open ends of the bag open at the part funnel to receive the part.

13. A part packing system for packing a part elongated along a longitudinal axis in an elongated bag, the part packing system comprising:

a bag dispensing machine having a supply of elongated bags located adjacent a bag rail, the bag dispensing machine having a bag manipulator holding a bag gripper mechanism, the bag manipulator moving the bag gripper mechanism to pull a length of the bag from the supply along the bag rail, the bag dispensing machine having a cutter configured to cut the elongated bag from the supply;

a bag holding machine including a bag end manipulator holding a first bag end gripper mechanism and a second bag end gripper mechanism, the bag holding machine configured to receive an end of the bag between the first and second bag end gripper mechanisms, the first and second bag end gripper mechanisms opening the end of the bag to form a mouth at the end of the bag; and a part loading machine including a part manipulator holding at least one part gripper mechanism configured to hold the part, the part manipulator moving the part gripper mechanism to a loading position upstream of the mouth of the bag, the part manipulator moving the part gripper mechanism to load an end of the part into the mouth of the bag to load the part into the bag.

14. The part packing system of claim 13, wherein the bag holding machine includes a part funnel having an opening configured to receive an end of the part, the bag end manipulator moving the first and second bag end gripper mechanisms to position the mouth of the bag immediately downstream of the opening of the part funnel, the part manipulator moving the part gripper mechanism to a loading position upstream of the part funnel and the part manipulator moving the part gripper to load an end of the part through the opening in the part funnel into the mouth of the bag to load the part into the bag.

15. The part packing system of claim 13, further comprising a product packaging machine configured to move the part and the bag when the part is in the bag, the product packaging machine having a product manipulator holding a product gripper mechanism, the product manipulator moving the product gripper mechanism away from the part funnel to a packaging container.

16. A method of packing a part in an elongated bag elongated along a longitudinal axis, the method comprising:

grabbing a top of the elongated bag at an end of the bag using a first bag end gripper mechanism;

grabbing a bottom of the elongated bag at the end of the bag using a second bag end gripper mechanism;

opening the end of the elongated bag to form a mouth;

moving the mouth of the bag into alignment with an opening of a part funnel;

grabbing the part using a part gripper mechanism;

loading the part into the mouth of the bag through the opening in the part funnel;

releasing the part from the part gripper mechanism into the bag;

grabbing the elongated bag with the part therein using a product gripper mechanism; and moving the elongated bag with the part therein to a packaging station using the product gripper mechanism.

17. The method of claim 16, wherein said grabbing the part using the part gripper mechanism includes picking up the part with a first part manipulator, moving the part with the first part manipulator to a second part manipulator and transferring the part from the first part manipulator to the part gripper mechanism of the second part manipulator, the second part manipulator moving axially in a loading direction to load the part into the bag.

18. The method of claim 16, further comprising dispensing the bag from a supply of elongated bags along a bag rail by pulling the end of the bag along the bag rail, and cutting a length of the bag from the supply using a cutter adjacent the bag rail.

19. The method of claim 16, further comprising moving at least one of the first bag end gripping mechanism and the second bag end gripping mechanism away from each other to open the mouth of the bag.

20. The method of claim 16, further comprising moving the part manipulator in three-dimensional space to position the part relative to the bag and load the part in the bag.

21. A part packing system for packing a part elongated along a longitudinal axis in an elongated bag, the part packing system comprising:

a bag holding machine including a part funnel having an opening configured to receive an end of the part, the bag holding machine including a bag end manipulator holding a first bag end gripper mechanism and a second bag end gripper mechanism, the bag holding machine configured to receive an end of the bag between the first and second bag end gripper mechanisms, the first and second bag end gripper mechanisms opening the end of the bag to form a mouth at the end of the bag, the bag end manipulator moving the first and second bag end gripper mechanisms to position the mouth of the bag immediately downstream of the opening of the part funnel;

a part loading machine including a part manipulator holding at least one part gripper mechanism configured to hold the part, the part manipulator moving the part gripper mechanism to a loading position upstream of the part funnel, the part manipulator moving the part gripper mechanism to load the end of the part through the opening in the part funnel into the mouth of the bag to load the part into the bag; and a product packaging machine configured to move the part and the bag when the part is in the bag, the product packaging machine having a product manipulator holding a product gripper mechanism, the product manipulator moving the product gripper mechanism away from the part funnel to a packaging container.

* * * * *